US005323169A

United States Patent [19]

Koslover

[11] Patent Number: 5,323,169

[45] Date of Patent: Jun. 21, 1994

[54] COMPACT, HIGH-GAIN, ULTRA-WIDEBAND (UWB) TRANSVERSE ELECTROMAGNETIC (TEM) PLANAR TRANSMISSION-LINE-ARRAY HORN ANTENNA

[75] Inventor: Robert A. Koslover, Albuquerque, N. Mex.

[73] Assignee: Voss Scientific, Albuquerque, N. Mex.

[21] Appl. No.: 2,713

[22] Filed: Jan. 11, 1993

[51] Int. Cl.[5] ..... H01Q 13/00

[52] U.S. Cl. ..... 343/786; 343/776; 333/136

[58] Field of Search ..... 343/772, 776, 786; 333/125, 128, 136, 137

[56] References Cited

U.S. PATENT DOCUMENTS

| | | | |
|---|---|---|---|
| 2,822,541 | 2/1958 | Sichak et al. | 343/776 |
| 3,277,489 | 10/1966 | Blaisdell | 333/125 |

FOREIGN PATENT DOCUMENTS

| | | | |
|---|---|---|---|
| 0031201 | 2/1987 | Japan | 333/125 |
| 0073601 | 3/1991 | Japan | 343/776 |
| 0197708 | 10/1975 | U.S.S.R. | 333/125 |
| 1394283 | 5/1988 | U.S.S.R. | 333/125 |

*Primary Examiner*—Donald Hajec
*Assistant Examiner*—Tan Ho
*Attorney, Agent, or Firm*—Marty Koslover Assoc.

[57] ABSTRACT

An antenna for the radiation of ultra-wideband pulsed electromagnetic radiation. The invention is a high gain, transverse electromagnetic parallel-plate, open-sided transmission-line array horn antenna utilizing a binary tree-based design, which produces a multiple number of paralleled horns and final radiation apertures, connected to a single signal feed waveguide. This invention antenna structure produces an equal path length for the signals in each of the paralleled branches, virtually eliminating phase error in the E plane and producing high gain characteristics over most of the desired radiation frequency range.

8 Claims, 4 Drawing Sheets

Fig. 1.
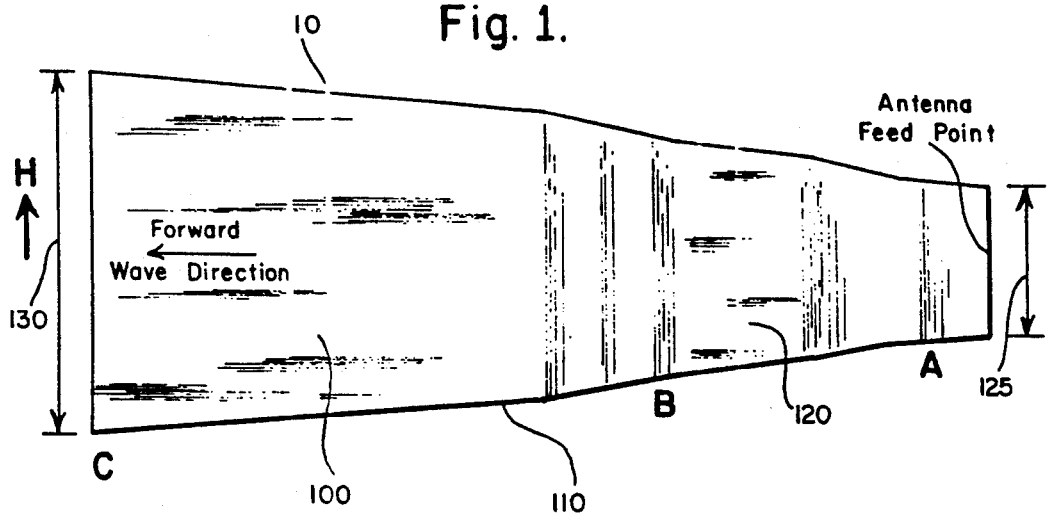
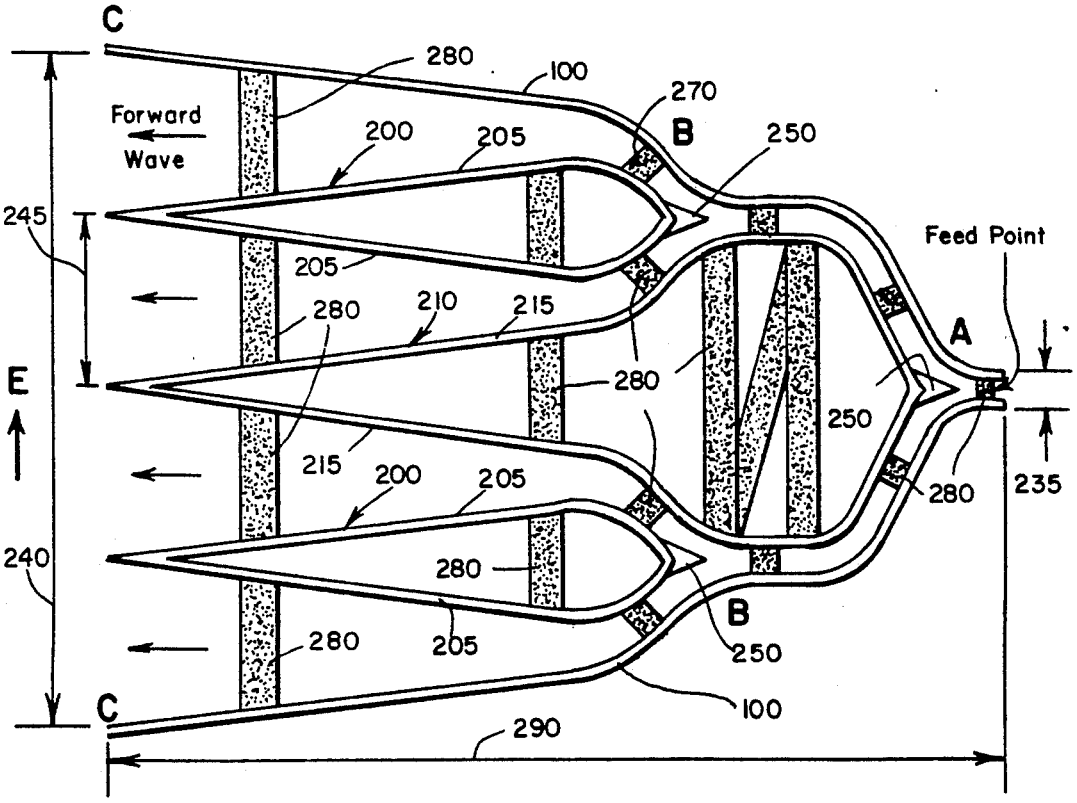
Fig. 2.

Fig. 9.
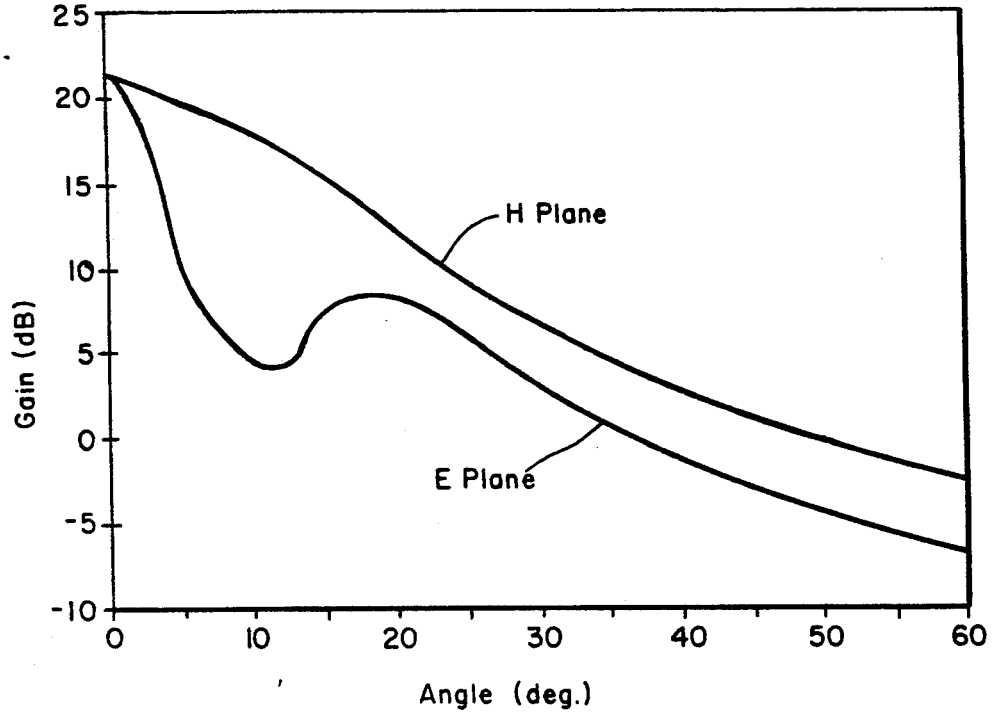
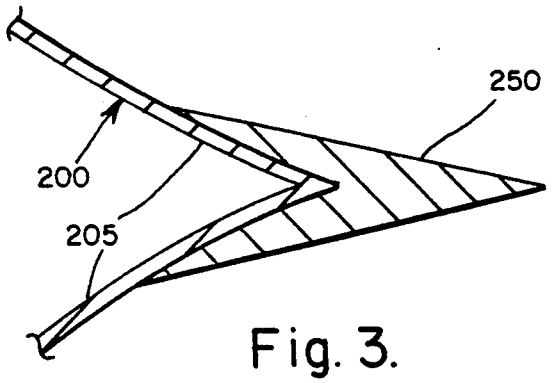
Fig. 3.
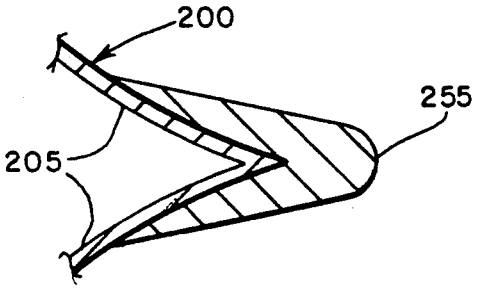
Fig. 4.

COMPACT, HIGH-GAIN, ULTRA-WIDEBAND (UWB) TRANSVERSE ELECTROMAGNETIC (TEM) PLANAR TRANSMISSION-LINE-ARRAY HORN ANTENNA

RIGHTS OF THE GOVERNMENT

This invention was made with Government support under Contract No. F29601-92-C-0028, awarded by the Department of the Air Force, Phillips Laboratory (AFSC)/PKRD. The Government has certain rights in the invention.

BACKGROUND AND SUMMARY OF THE INVENTION

This invention relates to the field of radio frequency radiation antenna devices, and particularly to an ultra-wideband (UWB) transverse electromagnetic (TEM)-mode horn antenna.

Ultra-wideband TEM horn antenna designs have been available for fifteen years or more, and are used by the military and others for applying pulsed electromagnetic radiation. Background discussions of TEM horn antenna characteristics are to be found in the papers by Evans, S., and Kong, F.N., "TEM Horn Antenna: Input Reflection Characteristics in Transmission", Proc. IEEE, Vol. 130H, Oct. 1983, pp. 403–409; and by Kerr, J. L., "Short Axial Length Broad-Band Horns" Trans. IEEE, Vol. AP-21, Sep. 1973, pp. 403–409.

In conventional TEM horn antenna design, single sources which offer the highest powers are used to drive single TEM horns. In some designs, multiple-phased, lower power sources drive arrays of horns, giving one source per antenna aperture. However, the path lengths from feed to aperture in the Electric field (E-plane) are not equal, giving rise to large phase error at all but the lowest frequencies, and resulting in low gain and directivity. The only way to improve this without a fundamental design change, is to make the horn much longer in length than it normally would be; which is impractical, expensive and cumbersome when large apertures are required.

It is therefore a principal object of this invention to provide an ultra-wideband TEM planar transmission-line-array horn antenna which is relatively compact for its directivity, and exhibits high-gain, directivity and acceptable losses. The invention is a high-gain, UWB, transverse electromagnetic (TEM) mode parallel-plate planar transmission-line-array horn antenna, utilizing a highly novel binary-tree based design to extend the effective length of antenna. High-power, UWB, radio-frequency electromagnetic pulses are input to the antenna on a two-conductor parallel-plate transmission line which propagates the pulses in the fundamental TEM mode. The signals enter the feed region and then pass to a series Tee parallel-plate, open transmission-line junction. The signal is divided into two signals at the Tee junction, which are then re-directed around curves at approximate 110 deg. bends, and further divided at paralleled Tees into a multiple number of paralleled signals. Each of the signals is conducted down a path of gently flared parallel plates forming a horn, to exit at a radiation aperture. The preferred embodiment utilizes two stages to form a binary tree, parallel-plate, transmission line configuration having four paralleled apertures. However, it is possible to utilize more than two stages, resulting in a larger multiple number of paralleled apertures.

The invention structure produces an equal path length for signals in each of the branches, virtually eliminating phase error in the E-Plane, and producing high gain characteristics over most of the desired frequency range.

BRIEF DESCRIPTION OF THE DRAWINGS

FIG. 1 is a top view of the present invention, particularly showing the symmetric, trapezoidal shape of the top and bottom plates;

FIG. 2 is a side elevation view of the present invention, particularly showing the open-sided parallel plate structure of the feed, the Tee sections and the horns, and the method of ensuring structural integrity;

FIGS. 3 and 4 are cross-sectional views of pointed and rounded septums which are inserted in the Tee sections to divide signal waveguide paths;

FIG. 9 is a plot of far-field energy deposition patterns in the E and H planes, computed for a two-stage, 4 aperture, binary-tree horn antenna according to the present invention.

DESCRIPTION OF THE PREFERRED EMBODIMENT

Figure 5:
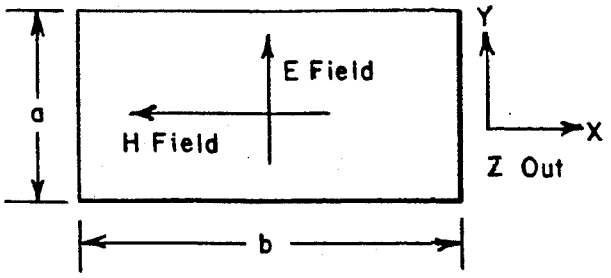
FIG. 5 is a diagram useful in clarifying the meanings of the coordinates and aperture dimensions used in the theory of operation text.

The nature of the invention is that of an antenna for the radiation of ultra-wideband (UWB) pulsed electromagnetic energy. In particular, it is a high-gain, UWB, transverse electromagnetic (TEM) mode, parallel-plate planar transmission-line array horn antenna, utilizing a binary-tree based design to dramatically reduce the serious problem of frequency dependent phase error, which plagues conventional UWB TEM horn antennas. The purpose of the invention antenna is to provide highly directional radiation of high power, UWB, radio-frequency electromagnetic pulses.

The constituent sections of the antenna are as follows:

a) a feed section waveguide for the purpose of receiving TEM radiated energy from a source;

b) a multiple number of waveguide stages, connected in cascade; each stage serving to double the number of input waveguides preceding it, and transmitting the energy from the feed section waveguide along multiple channels;

c) a multiple number of horn waveguides for receipt of the transmitted energy and its transmission from radiation apertures.

Refer to FIGS. 1 and 2. In the preferred embodiment, the number of waveguide stages is selected as two. This number being considered optimum for reasons explained later in the text. A first Tee section waveguide is connected to the output of the feed section at "A", forming a first stage. A second and third Tee section waveguide are each connected to an output arm of the first Tee section at "B", forming a second stage. Four parallel-plate horn waveguides are connected, each to an output arm of the second stage Tee sections, and complete the antenna transmission line.

Referring again to FIGS. 1 and 2. The construction of the antenna is based on the use of parallel plate, open-sided waveguide Tees and bends, and parallel plate horns. Each plate in each section is trapezoidal shaped. Sections are joined, end-to-end, forming continuous plates. One such continuous plate, an outer plate 100, is shown in the FIG. 1 plan view. In this preferred embodiment, a total of eight trapezoidal shaped metal plates 100, 205, 215, are used to form a symmetrical, two-branched, four-aperture antenna from its constituent sections.

The electric field (E-plane) radiated from the antenna is vertical, assuming the antenna to be oriented as in FIG. 2. The magnetic field (H-plane) is perpendicular to the paper as shown in FIG. 2.

The metal plates composing the antenna are arranged and spaced so that the vertical space between paralleled plates varies from a height of 4 cm at the feed point 235, to a height of 37.5 cm at each aperture 245. The outer plates 100, one of which is shown in FIG. 1, have a feed point width 125 of 24 cm, and sides 110 that flare linearly to an aperture end width 130 of 75 cm. The overall E-Plane (vertical) dimension of the antenna at the apertures is 1.5 m., and the overall length from feed point to the apertures "C" 290 is 2 m. The ratio of the radiation aperture H plane width 130 to E plane height 245 in this embodiment is selected as 2:1.

These dimensions are not fixed absolutely. The width and plate separation at the antenna feed point should be chosen to match the impedance of the source. The ratio of the radiation aperture width to height would normally be selected to provide the desired beam patterns in the E and H planes. Designs with very different beamwidths in the E and H planes are desirable in some applications. The embodiment example of 2:1 shown in FIGS. 1 and 2 is for an unequal beam-width design as is evident in FIG. 9.

The impedance of the parallel plate waveguide forming the antenna feed was chosen as 50 Ohms, which is a commonly encountered (but not universal) source impedance. This impedance requires a parallel plate waveguide having a width equal to six times the plate separation, thus the separation of 4 cm and width of 24 cm was selected. FIG. 5 is a reference diagram of the plate configuration in cross-section. At the antenna feed, dimension 'a' is 4 cm and dimension 'b' is 24 cm.

When the feed section waveguide, the Tee sections and horn waveguide sections are assembled together and connected as shown in FIG. 2, the overall configuration takes on a different aspect, with the joined plates forming continuous pieces. Thus, there are two outer pieces (plates) 100, a center piece 210 comprising first and second inner plates 215 joined together at each end; a first intermediate piece 200 comprising third and fourth inner plates 205 joined together at each end; a second intermediate piece 200 which is identical to the first, and comprising fifth and sixth inner plates 205 joined together at each end; three septum pieces 250, each of which is attached to a tee section division, dividing the waveguide leading into the tee shoulders; and a multiple number of balsa wood or rigid styrofoam blocks 280 to hold the plates at their proper positions and to provide structural integrity.

The two outer plates 100 are shown in FIG. 1 in plan view and on edge, in the side view of FIG. 2. Forming the Tees, the plates 100 are folded in two steps 120 and 110, with the second step 110 plane taking up half or more of the entire length of the plate 100. Thus, the length of the horn waveguides in the forward wave direction is at least half of the entire antenna waveguide length. This is done in the interest of minimizing E plane phase error.

A first bend is taken at 'A' in the two outer plates 100 soon after the antenna feed point, at an approximate angle of 110 deg to the transverse feed plane, rounding the bends gently and leveling out horizontally (180 deg) to form the first antenna stage 120. The center piece 210 first and second inner plates 215 are each bent and curved to follow and parallel the outer plates 100 through the first bend 'A' and first stage 120, gradually increasing the plate separations from the initial feed height to a few percent more in order to minimize side-directed radiation.

A septum piece 250 is attached to the end of the center piece 210, closest to the antenna feed, and serves as a divider for the Tee junction formed by the outer plates and the center section plates. FIGS. 3 and 4 illustrate two alternate septum piece cross-section shapes which may be used, a rounded leading edge and a more pointed edge. The appropriate shape is selected for maximum transmission over the desired frequency band.

The plates are separated and held apart by blocks 280 made of balsa wood or rigid styrofoam.

A second bend is taken at 'B' for the second Tee section, in the outer plates 100 after a short length arm of the first Tee section at an approximate angle of 45 deg. (or 135 deg.) to the horizontal, rounding the bends gently to minimize reflections of the transmitted signal and to form the second stage 100 in the antenna which continues in a horn waveguide plate forming an angle of approximately 8 deg. with the horizontal plane.

The second bend above in the outer plates, is also formed symmetrically in the first and second plates 215 of the center piece 210. The first and second plates 215 are then bent at an approximate angle of 8 deg. to the horizontal and are joined at the aperture edge. Thus the included angle between plates in the second stage of this antenna is approximately 16 deg. This is also included angle or the 'flare' in the second or final step of each of the four paralleled horns, ending in the radiating apertures.

The first and second intermediate pieces 200 of the antenna each comprise two identical inner plates 205 which are shaped symmetrically. In each intermediate section, the plates 205 are joined together at their 'Tee' edge and at their aperture edge. The plates 205 are bent outward and curved symmetrically to form a 'tear-drop' shaped cross-section, with its curved section at the 'Tee' edge of the forward wave, and its pointed edge at the aperture edge of the forward wave. The curved surfaces near the 'Tee' edge fit inside and parallel the inner surfaces of the outer plates 100 and the center section plates 215 at the second stage "B" forming two symmetrical Tee sections in the antenna. The remainder of the intermediate piece 200 plate surfaces 205 is bent at an angle of approximately 8 deg. to the horizontal, joining at their aperture edge. This produces a horn flare included angle of approximately 16 deg. The horn flare included angle should be limited to a maximum of 30 deg. to avoid undue losses and phase error.

A septum 250 is attached at the equivalent Tee section surface of each intermediate piece for the purpose of maximizing the signal transmission over the desired frequency band. As in the case for the septum used in the first Tee section in the antenna, the second Tee sections may require pointed or rounded septums to efficiently direct the input waveform. These may be selected during test of the antenna.

The plates of the four paralleled horns are held in place by multiple separators 280 made of balsa wood or rigid styrofoam. Separators 280 are placed between the first two branches of the antenna as a structural support, and also between the plates of the center and intermediate sections as structural supports.

The plates should be made of materials which are good conductors, such as copper or aluminum. The materials used for the separators to hold the plates together properly should be insulators with low dielectric constants at RF frequencies. Examples of separators and structural supports already mentioned are balsa wood or rigid styrofoam (not the anti-static kind), which are held in place by epoxy or small plastic screws.

The above described antenna was designed based on the following requirements: high radiated power pulses of 100 MW to 10 GW; a frequency range of 100 MHz to 6 GHz; a feed impedance of 50 Ohms, and an unequal (in the E and H planes) radiated beam-width.

The number of stages or divisions in the antenna is equal to two, occurring at locations 'A' and 'B'. See FIGS. 1 and 2. Obviously, alternative designs with different numbers of divisions, ranging from 1 to any number are possible. However, for a fixed aperture size, increasing the number of divisions decreases the phase error in the E plane, but unfortunately also increases the overall losses (thus decreasing gain) because of losses in the Tees and bends added at each stage. By theoretical analysis, it can be shown that the phase error in the E plane is approximately proportional to the square of the aperture dimension in the E plane. Thus, reducing the linear dimension size of an aperture by a factor of n results in a reduction in phase error by a factor of $n^2$, other things being equal. To get the phase error greatly reduced, only a small number of stages are required for all frequencies where phase error would otherwise be a serious problem. At stage numbers n above 2 or 3, the calculated losses due to the additional Tees and bends tends to cancel the gain produced by the reduction in phase error. Thus, a selection of 2 or 3 antenna stages is optimum for the above frequency range.

Regarding the antenna geometry, the following considerations are believed to be significant: The length of the first Tee section (at 'A') should be about twice the length of the second step Tee sections, since the first Tee section has to yield waveguides twice as far apart as those appended to the second step Tee sections.

The final flaring sections (horns) of the antenna (from 'B' to 'C') should have a length at least half of the overall antenna waveguide length, and be made as long in the forward wave direction as possible, commensurate with fitting in the Tees and bends within an overall constrained antenna length 290.

In the time-domain equation for phase error the terms $L_x$ and $L_y$ define phase error. As $L_y$ (in the forward wave direction) tends to infinity, the phase error goes to zero. Thus, the longer the horn section (and the overall guide length), the lower the phase error.

The included angle between plates in the final horn sections should not exceed 30 deg. since excessive flare has been found to be detrimental to high gain.

Based on testing conducted to date, the radii of curvature of the bends in the waveguides should be at least six or seven times the height (separation) of the waveguide plates at the bends. This is necessary to produce a generally adiabatic Tee design having an efficiency of at least 80 percent and to produce a smooth transition.

Additionally, the edges of the plates are field-enhancement locations. It is recommended that these be rounded, particularly in the feed region.

Finally, the aperture selected should have a ratio of width to height appropriate to generating the desired beam pattern.

THEORY OF OPERATION

The key factor that makes this invention an improvement over other types of antennas, and in particular better than conventional TEM horns, is that the phase error exhibited by the invention is much less than for a conventional TEM horn antenna, particularly in the E plane. This results in higher gain. The theory behind this is discussed now in some detail.

a) Phase Error and Radiated Field

The radiated electric field from an aperture antenna in the frequency domain (i.e., for a single frequency wave,) may be written using the Stratton-Chu formula.

Among many others, this formula is to be found in "Principles of Antenna Theory" by Kai Fong Lee, John-Wiley and Sons, 1984, Chapter 10, "Aperture Antennas", Eq. 10.1, p. 268.

$$\vec{E} = \frac{jk}{4\pi} \int \int_S \frac{e^{-jkR}}{R} \{(\hat{n} \times \vec{E}_s) \times \hat{R} + \eta[(\hat{n} \times \vec{H}_s) \times \hat{R}] \times \hat{R}\} dS \quad (1)$$

Where $E_s$ and $H_s$ are the fields on the aperture, R is the vector from an aperture field point to the radiated field point, n is the unit outward normal from the aperture, k is the wave number $k = 2\pi/\lambda$, and $\eta$ is the impedance of free space:

$$\eta = \sqrt{\mu_o/\epsilon_o} = 377 \text{ Ohm.}$$

The integration is over the aperture surface, denoted by S. The Stratton-Chu formula can also be written in the time domain. In particular, the time domain form may be derived from Eq. (1) by means of Fourier transforms and integration by parts. The resulting expression is:

$$\vec{E}(t) = \frac{1}{4\pi c} \int \int_S \frac{dS}{R} \left\{ \left( \hat{n} \times \frac{\partial \vec{E}_s}{\partial t'} \Big|_{t'=t-R/c} \right) \times \hat{R} + \eta \left[ \left( \hat{n} \times \frac{\partial \vec{H}_s}{\partial t'} \Big|_{t'=t-R/c} \right) \times \hat{R} \right] \times \hat{R} \right\} \quad (2)$$

Note the use of "retarded" time $t'=t-R/c$ in Eq. (2).

Both Eqs. (1) and (2) are approximate expressions of the Kirchoff type. They are both useful and valid when the aperture fields, which must be inserted, are known with reasonable accuracy, and diffraction at the aperture edges is not too severe.

Eqs. (1) and (2) are useful in the radiating near-field region as well as in the far-field. In general, however, only the far-field expressions are needed and for a continuous wave (CW) analysis, Eq. (1) may be used. For short-pulse broadband phenomena, Eq. (2) is used after first defining the waveform at the aperture. Although the effects of phase error will be included (very important here) it is assumed that the field amplitude at the aperture is essentially a sinewave multiplied by a Gaussian, with a position-dependent time delay which is the time-domain equivalent of phase error. Thus the $E_s$ field equation is:

$$E_s(x,y,t) = E_o \sin\left(\frac{2\pi(t\delta t(x,y))}{\tau_1}\right)\exp\left(-\frac{(t-\delta t(x,y))^2}{\tau_2^2}\right) \tag{3}$$

with $$\delta t(x,y) = \frac{1}{c}\left(\sqrt{L_x^2+x^2} - L_x + \sqrt{L_y^2+y^2} - L_y\right) \tag{4}$$

The variables $\tau_1$ and $\tau_2$ are the two basic time scales of the wave. For a sinewave, we let $\tau_2$ tend to infinity, which causes the exponential part of Eq. (3) to go to unity. $\tau_1$ is the sinewave period. At another extreme, setting $\tau_2=\tau_1/2$ yields a wave that is essentially only one single cycle in duration.

$L_x$ and $L_y$ are terms that define the phase error. Their physical interpretation is that they are separate radii of curvature of cylindrical phase fronts, which together form the combined phase front at a rectangular aperture. As both $L_x$ and $L_y$ tend to infinity, the overall phase error in both the E and H planes goes to zero.

In Eqn. (3), defining $R=R_o-\rho \sin\phi$, $T=t-R_o/c$, differentiating Eq. (3) with respect to time, substituting into Eq. (2), letting $H=E/\eta$ at the aperture and considering the far field limit, yields an expression for the radiated field given in Eq. (5).

$$E(t) = \frac{E_o(1+\cos\phi)}{2\pi c R_o} \times \left\{1 - \frac{1}{\tau_2^2}\int\int_S dS \exp\left[-\left(T - \delta t + \frac{\rho\sin\phi}{c}\right)^2/\tau_2^2\right]\left(T - \delta t + \frac{\rho\sin\phi}{c}\right)\sin\left[\frac{2\pi}{\tau_1}\left(T - \delta t + \frac{\rho}{c}\sin\phi\right)\right] + \frac{\pi}{\tau_1}\int\int_S dS \exp\left[-\left(T - \delta t + \frac{\rho\sin\phi}{c}\right)^2/\tau_2^2\right]\cos\left[\frac{2\pi}{\tau_1}\left(T - \delta t + \frac{\rho}{c}\sin\phi\right)\right]\right\} \tag{5}$$

where $\rho$ is defined as equal to x when computing radiated fields in the H plane, and equal to y when computing radiated fields in the E plane. Where $\phi$ is the angle of the observation point with respect to the z-axis (boresight) in either case, and $R_o$ is the distance from the aperture center to the radiated point in question.

Eqn. (5) for the radiated fields is solved numerically because of the x,y dependence of $\delta t$. This has been done by a specially written computer program.

b) Directivity and Gain

For an antenna radiating short pulses, directivity is defined at a point in space as the energy flux radiated to it divided by what the energy flux would have been if the source was isotropic.

The gain includes both the directivity of the antenna and any multiplicative factors (less than unity) which characterize the efficiency of the antenna. Thus the gain is the directivity multiplied by the ratio of the total radiated energy to the total input energy, thereby accounting for losses.

In the energy-based directivity definition for directivity g in Eqn. (6):

$$g(\theta,\phi) = \frac{u(\vec{r})}{u_1(\vec{r})} \tag{6}$$

where u(r) is the radiated energy flux actually delivered to point r, and $u_i$ (r) is the energy flux that would be delivered if the antenna were an isotropic radiator.

The energy flux at point r is directly related to the E field there by:

$$u(\vec{r}) = \frac{1}{\eta}\int_{\text{Pulse}} E^2(\vec{r},t)dt \tag{7}$$

while the isotropic energy flux there is given by:

$$u_i(\vec{r}) = \frac{U_{tot}}{4\pi r^2} \tag{8}$$

Utot is the total radiated energy, given by:

$$U_{tot} = \frac{1}{\eta}\int_{-a/2}^{a/2} dy \int_{-b/2}^{b/2} dx \int_{\text{Pulse}} E_s^2(x,y,t)dt \tag{9}$$

Substituting the various expressions above into Eq. (6) yields Eq. (10):

$$g(\theta,\phi) = \frac{4\pi r^2 \int_{\text{Pulse}} E^2(\vec{r},t)dt}{\int_{-a/2}^{a/2} dy \int_{-b/2}^{b/2} dx \int_{\text{Pulse}} E_s^2(x,y,t)dt} \tag{10}$$

which is a useful expression for directivity for pulsed waveforms. Note that Eq. (10) reduces exactly to the conventional expression for CW gain if the pulse is sinusoidal and the time integrals are taken over any integer number of wavelengths.

The above equations and method were used to design the present invention antenna, and also to compute the directivity and gain for a current state-of-art conventional horn antenna and an equivalent power/frequency two-stage, binary-tree horn antenna constructed according to the present invention. The performance of each antenna was then compared to determine the degree of improvement in reduction of phase error and increase in gain offered by the two-stage binary-tree horn antenna. The results of this computation and comparison are now presented.

Figure 6:
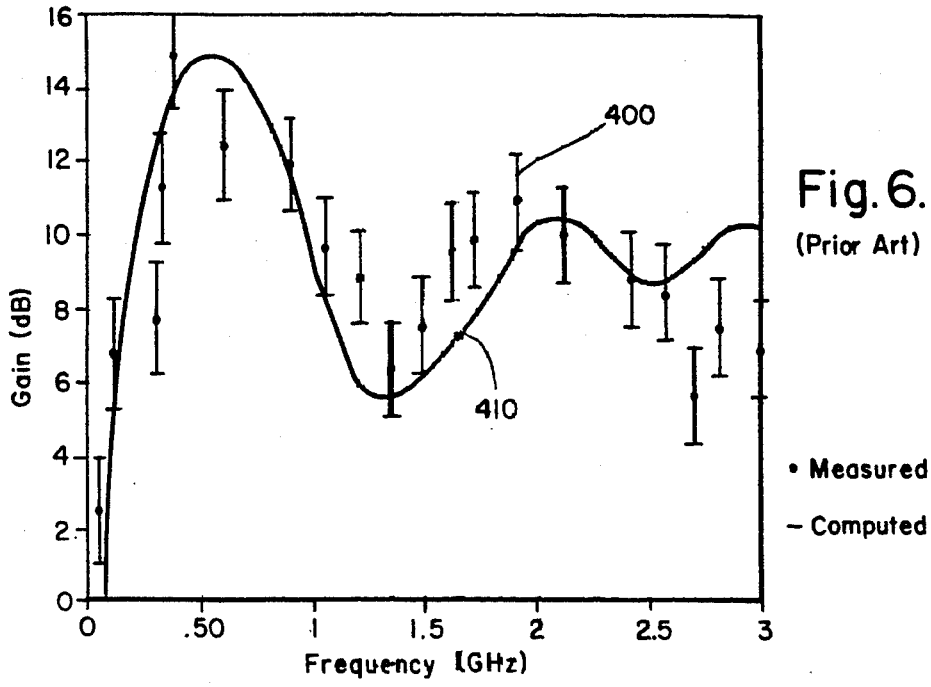
Fig. 6. (Prior Art)
FIG. 6 is a plot of measured and computed CW directivities (gain) for a conventional state of the art TEM horn antenna, and useful as a reference mark.

Refer now to FIG. 6. The figure shows a plot of the measured 400 and computed CW directivities (gain) for a conventional state-of the-art TEM horn antenna in use at the Air Force Phillips Laboratory, Kirtland AFB, NM. The antenna is about 1.15 m high (E plane), 1.5 m wide (H plane), with an overall length of slightly over 2 m. The horn in FIG. 6 was modeled by setting (see FIG. 5) a =1.15 m high (E plane), b =1.5 m wide (H plane), $L_x$=1.15 m and $L_y$=0.93 m. This results in the fairly good fit between the empirical measured data 400 and the computed curve 410. It is notable that the gain vs. frequency curve in FIG. 6 is dominated by phase error effects for all frequencies above roughly 500 MHz.

Figure 7:
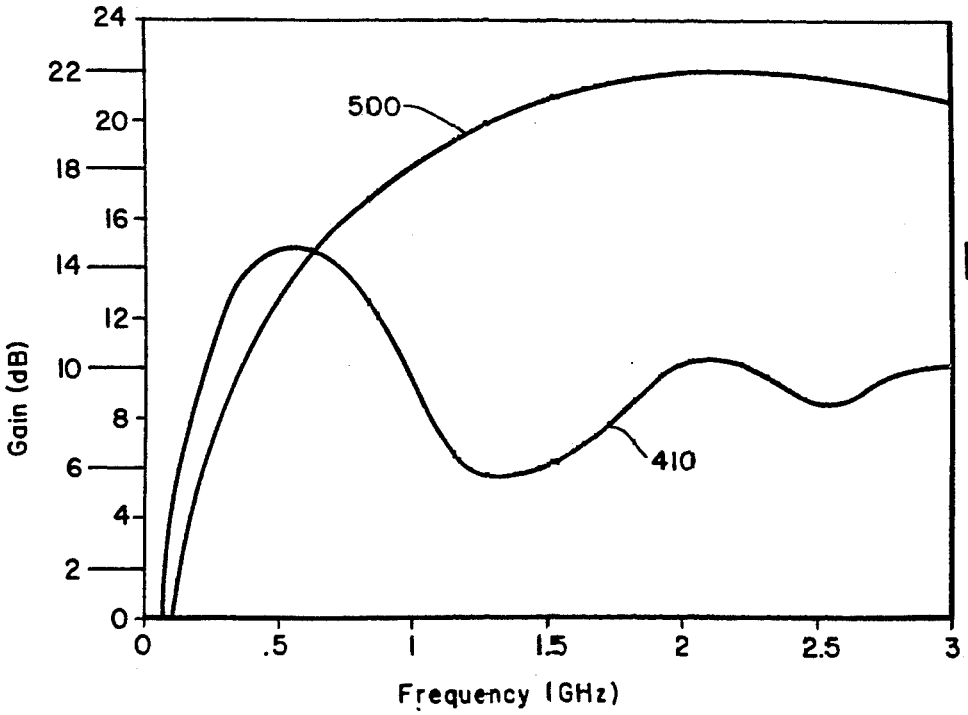
FIG. 7 is a plot comparing the computed gain of a two-stage binary-tree TEM horn antenna of the present invention with a known conventional TEM horn antenna.

Referring now to FIG. 7, there is shown a plot of the CW directivity (gain) vs. frequency curves for the conventional USAF TEM horn antenna 410 discussed earlier, and an equivalent two-stage binary-tree TEM horn antenna 500 of the present invention. The binary-tree horn antenna employs a 35% smaller aperture area than the conventional TEM horn antenna.

First, it is notable that the gain of the invention antenna 500 far exceeds that of the conventional antenna 410 over the frequency range above 600 MHz. It is obviously much better to reduce the H plane dimension of the antenna and to increase the E plane dimension when using a binary-tree type horn, to better take advantage of the significant reduction in the E plane phase error as compared to the H plane phase error.

Second, there is a loss in output of the binary-tree type horn that shows up in the lower frequencies below 600 MHz. This is due to imperfect transmissions through the Tees and bends. At the low frequency end, where phase error does not dominate, these losses actually reduce the power on target by approximately 3 dB for a two-stage design. However, the 35% smaller aperture area of the binary-tree horn considered here still offers superior performance throughout most of the frequency range.

Figure 8A:
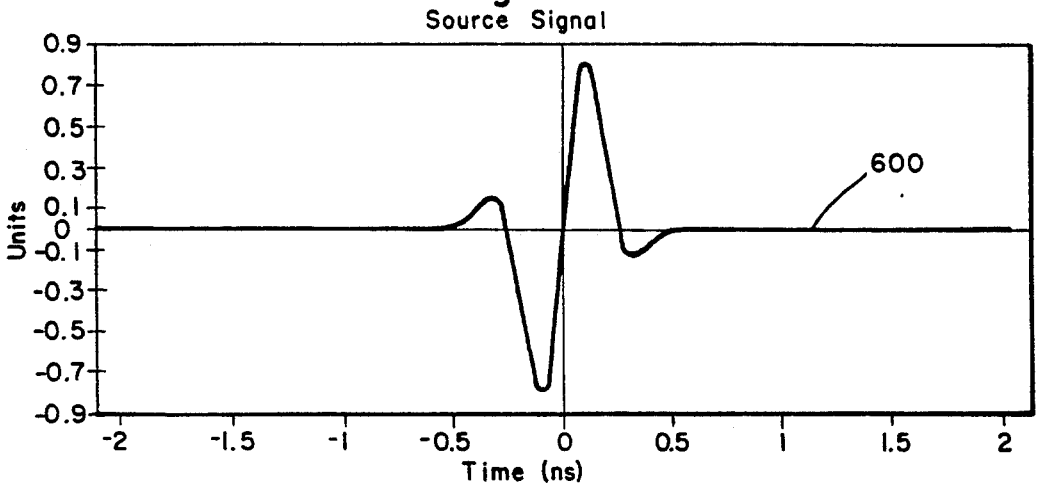
FIG. 8*a* is a time domain plot of a source signal pulse which is applied to feed of either a conventional TEM horn antenna or a two-stage binary-tree TEM horn antenna.
Figure 8B:
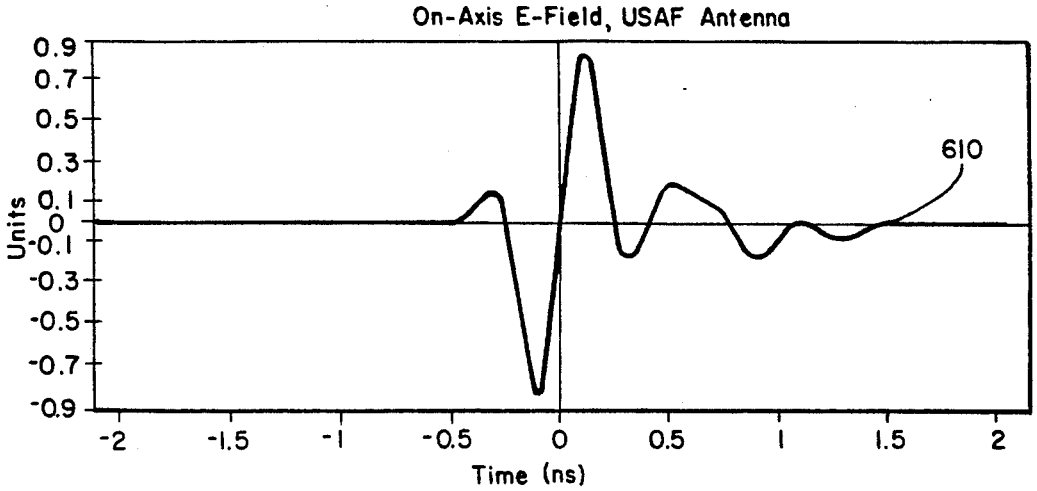
FIGS. 8*b* and 8*c* are time domain plots of the radiated response to the FIG. 8*a* source signal by a conventional TEM horn antenna (8*b*), and by a two-stage binary-tree TEM horn antenna; and useful in comparing the effects of phase error.
Figure 8C:
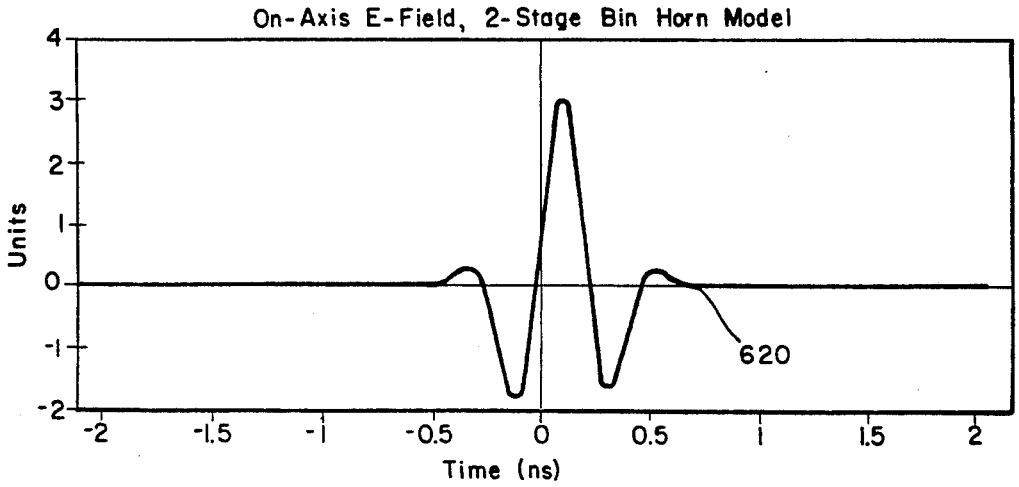

FIG. 7 showed a CW comparison of the gain for the two different TEM horns. We can also show the time domain responses for a short pulse. Refer now to FIGS. 8*a*, 8*b* and 8*c*. FIG. 8*a* is a plot of the driving waveform 600 of the source signal in units vs. time. Since a far-field pattern is being used, the ordinate axis is in units rather than volts/meter.

FIG. 8*b* shows the on-axis E field 610 of the conventional USAF TEM horn antenna in response to the driving signal of FIG. 8*a*. The USAF horn radiates a signal which looks more like a replica, rather than a time derivative. This is a well known property of high phase-error antennas. There is also considerable distortion present.

By comparison, the on-axis E field of the two-stage binary-tree TEM horn antenna plotted in FIG. 8*c* shows a nearly ideal, first-derivative temporal response 620 which is much stronger than that of the conventional USAF TEM horn. The waveform shape 620 is indicative of the greatly reduced phase error in the E plane.

The previous figures have shown the gain versus frequency and the computed on-axis radiated signal response to a specific driving UWB signal. It is also instructive to examine the E plane and H plane energy deposition patterns for this embodiment of the invention. These are shown in FIG. 9 for the same driving conditions used in FIG. 8*a*.

An estimated loss of 3 dB in the structure follows from the use of 2 Tees and 2 bends in each signal path. This loss amount is based on laboratory measurements, plus an allowance, taken for Tees and bends having the dimensions and configuration according to the embodiment of the invention.

The value of 3 dB used compares conservatively with the calculated values for the losses. With 80% efficiency for each Tee and 90% for each bend, the overall efficiency is computed at $0.8\times0.9\times0.8\times0.9=0.52$, or 52% for a loss of 2.853 dB.

Note that in FIG. 9, the sidelobes are not discernible in the H plane, and only the first sidelobe is distinguishable in the E plane. This is not cause for concern. It is simply due to the application of short pulses rather than CW operation, and some phase error.

ADVANTAGES

From the previous discussion and comparison, it is clear that the preferred embodiment of the invention antenna, show in FIGS. 1 and 2 has several advantages over current conventional TEM horn antennas. These are:

1. A stronger and less distorted, radiated waveform.
2. Much higher gain and directivity over most of its intended frequency range.
3. The ability to output a given level of short-pulse, ultra wideband power in a more compact, smaller antenna than a conventional horn antenna.

The known disadvantages are: (1) structure losses at the lowest frequencies cause significant loss of gain in this region, and (2) the invention configuration antenna is somewhat harder to build than a conventional horn antenna.

The most critical feature is the use of novel parallel-plate waveguide Tees and bends to route a single input signal to several TEM horn apertures, in a manner that is both efficient and which greatly reduces phase error in the E plane. It is this feature which produces the present invention UWB, transverse electromagnetic (TEM) planar transmission-line-array horn antenna and makes it a considerable advance over current conventional horn antennas.

It will be appreciated by those skilled in the art, that various modifications may be made to the embodiment of the invention described herein. These modifications are considered to be within the spirit and scope of the invention as set forth in the appended claims.

Having described the invention, what is claimed is:

1. An ultra-wideband, transverse electromagnetic (TEM) planar horn antenna comprising the combination of:

(a) a feed section TEM waveguide having an input and output aperture; said waveguide comprising two parallel plates forming a two-conductor transmission line receiving TEM mode radiated energy from a source thereof, said parallel plates of said feed section having a separation in the vertical E plane and a width in the horizontal H plane sized to match the impedance of said source; said parallel plates being held apart by separator blocks;

(b) a first Tee division TEM waveguide formed of conductive plates, having a single input aperture connected to the output aperture of said feed section waveguide; said Tee division TEM waveguide having two output apertures; said output apertures being arranged symmetrically in the vertical E plane, above and below a horizontal axis of symmetry defined by the horizontal center axis of said feed section waveguide; said plates being held apart by separator blocks; said first Tee waveguide forming a first antenna stage;

(c) second and third Tee division TEM waveguides formed of conductive plates, each said second and third Tee waveguide having a single input aperture connected to an output aperture of said first Tee division TEM waveguide; said second and third waveguides each having two output apertures; said second and third Tee waveguide output apertures being arranged symmetrically in the vertical E plane, above and below a horizontal axis of symmetry defined by the horizontal center axis of said first Tee waveguide outputs; said plates being held apart by separator blocks; said second and third Tee waveguides in parallel forming a second antenna stage; and (d) four TEM, open sided horn waveguides; each said horn comprising two plates held apart by separator blocks; each said waveguide being shaped outwardly flared between plates, having a narrow input aperture matching the output apertures of said second and third Tee waveguides; said horn waveguide plates flaring apart at an included angle of 16 to 30 degrees maximum from said input aperture to an output in the vertical E plane; each said horn waveguide having its input aperture connected to one of the four output apertures of said second and third Tee waveguides and arranged so that said four horn waveguides are located vertically one above the other in the E plane;

said TEM planar horn antenna by the joining of said foregoing waveguides, having continuous plates and thus an overall length comprising the added lengths of said feed section waveguide, said first Tee waveguide, said second Tee waveguide and a horn waveguide;

said TEM planar horn antenna being constructed by the combination of said waveguides to provide an equal signal path length in the E plane from said feed section to any said parallel horn output aperture, thus greatly reducing signal phase error in the E plane and increasing the output signal gain.

2. The TEM planar horn of claim 1, wherein said separator blocks includes blocks of balsa wood or rigid styrofoam which are insulators with low dielectric constants at RF frequencies; said blocks being attached to said plates by epoxy or by small plastic screws.

3. The TEM planar horn antenna of claim 1, wherein:

said each Tee division TEM waveguide is a open-sided waveguide, shaped to form an open neck aperture for the waveguide signal input on its central, horizontal axis, and shoulder portions for the cross-bar of the Tee; said open-sided waveguide also being bent in a curve at the end of said shoulder portions to form two arm waveguide portions which are paralleled with said neck, said arm portions providing the waveguide output apertures for the signal outputs of said TEE waveguide and extending, symmetrically spaced above and below a horizontal axis of symmetry defined by the horizontal axis of said waveguide open neck input;

said each Tee division waveguide having a plate separation spacing increasing gradually from its input neck aperture height to its output arm apertures by a few degrees flare in order to minimize side-directed radiation;

said each Tee division waveguide input and output aperture height being matched to its connecting input or output waveguide section to ensure smooth signal transmission;

said first, second and third Tee division waveguides connected in series parallel to said feed section waveguide, providing four output apertures arranged symmetrically in the vertical E plane for connection to said output apertures of said horn waveguides, and providing equal path-lengths in the E plane for a single input radio frequency signal, thereby minimizing signal E plane phase error.

4. The TEM planar horn antenna of claim 3, wherein said each Tee division waveguide is gently curved at its neck-to-shoulder portion transition and at its shoulder-to-arm portion transition, each said transition having a radius of curvature of at least six times the height of the waveguide plates at the transition bend, thereby minimizing reflections of the transmitted signal and decreasing signal transition losses.

5. The TEM planar horn antenna of claim 3, wherein said each Tee division includes a septum piece; said septum piece having an arrowhead shaped cross-section and a width equal to the width of the plates at the neck curve of the Tee; said septum piece being attached at its base to the plates, located and centered on the horizontal axis of neck portion, with its leading edge equally dividing the waveguide separation between the transition to the two shoulder portions; said septum leading edge being either pointed or rounded as selected by test to efficiently direct the input waveform; said septum piece serving as a divider for the Tee junction of the waveguide and acting to maximize the signal transmission over the desired frequency band.

6. The TEM planar horn antenna of claim 1, wherein all the plates forming said feed section, Tee division waveguides and horn waveguides are trapezoidal shaped; each plate having its shortest width at it input aperture edge, and its longest width at its distal output aperture edge, each said plate having sides which flare linearly from its input aperture edge to its output aperture edge; all said plates being made of materials which are good conductors.

7. The TEM planar horn antenna of claim 1, wherein each said horn waveguide has a length in the forward wave direction equal to or more than half said overall length of the TEM planar horn antenna, said horn waveguide output aperture being sized to have its H plane width to E plane height in proportion of 2:1 to produce an unequal radiated beam width.

8. The TEM planar horn antenna of claim 7, wherein said horn waveguide output aperture has any selected ratio of H plane width to E plane height, suitable to produce desired radiated beam patterns in the E and H planes.

* * * * *